US011761132B2

(12) United States Patent
Gupta

(10) Patent No.: US 11,761,132 B2
(45) Date of Patent: Sep. 19, 2023

(54) ERGONOMIC SEAM RIPPER

(71) Applicant: Nikhil Gupta, Schaumburg, IL (US)

(72) Inventor: Nikhil Gupta, Schaumburg, IL (US)

( * ) Notice: Subject to any disclaimer, the term of this patent is extended or adjusted under 35 U.S.C. 154(b) by 0 days.

(21) Appl. No.: 17/588,640

(22) Filed: Jan. 31, 2022

(65) Prior Publication Data

US 2022/0259782 A1 Aug. 18, 2022

Related U.S. Application Data

(60) Provisional application No. 63/150,144, filed on Feb. 17, 2021.

(51) Int. Cl.

| | |
|---|---|
| ***D05B 89/00*** | (2006.01) |
| ***A62C 13/62*** | (2006.01) |
| ***A41H 31/00*** | (2006.01) |
| *A62C 99/00* | (2010.01) |

(52) U.S. Cl.

CPC ..... *D05B 89/00* (2013.01); *A41H 31/005* (2013.01); *A62C 13/62* (2013.01); *A62C 99/0018* (2013.01)

(58) Field of Classification Search

CPC ..... D05B 89/00; A41H 31/005; D04B 3/00; D04B 3/02

See application file for complete search history.

(56) References Cited

U.S. PATENT DOCUMENTS 1,351,010 A * 8/1920 Bell ..... D05B 89/00 83/697
2,370,440 A * 2/1945 Beavin ..... A41H 31/005 30/DIG. 8
2,610,399 A * 9/1952 Adams ..... B43M 7/002 30/294
2,693,641 A * 11/1954 Omoto ..... D05B 89/00 30/294
3,100,935 A * 8/1963 Hargrave ..... A41H 31/005 30/294
3,975,822 A * 8/1976 Mabus ..... A41H 31/005 30/294
5,297,340 A * 3/1994 Kahlcke ..... D05B 89/00 30/DIG. 8

(Continued)

*Primary Examiner* — Danny Worrell
(74) *Attorney, Agent, or Firm* — Dunlap Bennett & Ludwig, PLLC; Anna L. Kinney

(57) ABSTRACT

An ergonomic seam ripper includes: (a) an elongated haft with a bulged profile having a larger cross-section about its medial portion than cross-section at a palm end of the haft, the cross-section about the medial portion of the haft also being larger than a cross-section at a thumb grip end of the haft, wherein the palm end of the haft has an outer surface of generally planar structure and the haft is further characterized by a mounting portion at the thumb grip end of the haft; (b) a gripping member secured to the mounting portion of the haft made of a resilient rubbery material with a plurality of gripping ribs extending thereabout, wherein the gripping ribs are spread relatively close together at an upper portion thereof and relatively further apart at a lower portion thereof; and (c) a U-shaped cutting blade with a tapered projection and balled projection, as well as a shaft, wherein the shaft of the blade is secured to the haft such that the tapered projection is aligned with the upper portion of the gripping member and the balled projection is aligned with the lower portion of the gripping member.

16 Claims, 3 Drawing Sheets

(56) References Cited

U.S. PATENT DOCUMENTS

| | | | | |
|---|---|---|---|---|
| 5,896,667 | A * | 4/1999 | Hawkins | B26B 3/00 30/294 |
| D418,672 | S * | 1/2000 | Mobbs | D3/18 |
| 6,516,521 | B1 * | 2/2003 | Rush | A01K 14/00 30/294 |
| D624,568 | S * | 9/2010 | Papenfuss | D15/78 |
| D633,113 | S * | 2/2011 | Selter | D15/66 |
| D701,040 | S * | 3/2014 | Hatcher | D3/18 |
| 8,713,766 | B2 * | 5/2014 | Wiman | A41H 31/005 7/161 |
| 8,984,912 | B1 * | 3/2015 | Akin | D04B 33/00 66/1 A |
| D792,705 | S * | 7/2017 | Farnum | D3/18 |
| D820,582 | S * | 6/2018 | Farnum | D3/18 |
| 10,219,567 | B2 * | 3/2019 | Farnum | A41H 31/00 |
| 10,427,310 | B2 * | 10/2019 | Scimone | D05B 89/00 |
| 10,729,198 | B2 * | 8/2020 | Iwasaki | A41H 31/005 |
| 10,834,984 | B2 | 11/2020 | Farnum et al. | |
| D926,460 | S * | 8/2021 | She | D3/18 |
| D926,461 | S * | 8/2021 | She | D3/28 |
| 2007/0125398 | A1 * | 6/2007 | Johnson | A45D 2/00 132/200 |
| 2014/0277042 | A1 * | 9/2014 | Racenet | A61B 17/320016 606/170 |
| 2019/0104794 | A1 | 4/2019 | Iwasaki et al. | |

* cited by examiner

ERGONOMIC SEAM RIPPER

CLAIM FOR PRIORITY

This application is based on U.S. Provisional Application No. 63/150,114 of the same title filed Feb. 17, 2021, the priority of which is hereby claimed and the disclosure of which is incorporated herein by reference.

TECHNICAL FIELD

The present invention relates to seam rippers with a U-shaped cutting blade.

BACKGROUND

Seam rippers with U-shaped cutting blades are known in the art. See, for example U.S. Pat. No. 10,834,984 to Farnum et al. Typically, such devices have a handle or haft with a hemispherical butt-end.

SUMMARY OF INVENTION

It has been found in accordance with the present invention that a seam ripper with a U-shaped cutting blade, an ergonomically shaped haft and a resilient gripping portion provides improved performance and comfort to a user.

In particular, there is provided an ergonomic seam ripper comprising: (a) an elongated haft with a bulged profile having a larger cross-section about its medial portion than cross-section at a palm end of the haft, the cross-section about the medial portion of the haft also being larger than a cross-section at a thumb grip end of the haft, wherein the palm end of the haft has an outer surface of generally planar structure and the haft is further characterized by a mounting portion at the thumb grip end of the haft; (b) a gripping member secured to the mounting portion of the haft made of a resilient rubbery material with a plurality of gripping ribs extending thereabout, wherein the gripping ribs are spread relatively close together at an upper portion thereof and relatively further apart at a lower portion thereof; and (c) a U-shaped cutting blade with a tapered projection and balled projection, as well as a shaft, wherein the shaft of the blade is secured to the haft such that the tapered projection is aligned with the upper portion of the gripping member and the balled projection is aligned with the lower portion of the gripping member.

The inventive seam ripper was so effective and comfortable to use that at least one panelist during focus groups asked to keep a prototype; a surprising result rarely, if ever, occurring during consumer testing, noted below.

Further details and advantages are apparent from the following description and appended Figures.

BRIEF DESCRIPTION OF DRAWINGS

The invention is described in detail below with reference to the drawings, wherein like numerals designate similar parts and wherein.

DETAILED DESCRIPTION

Figure 1:
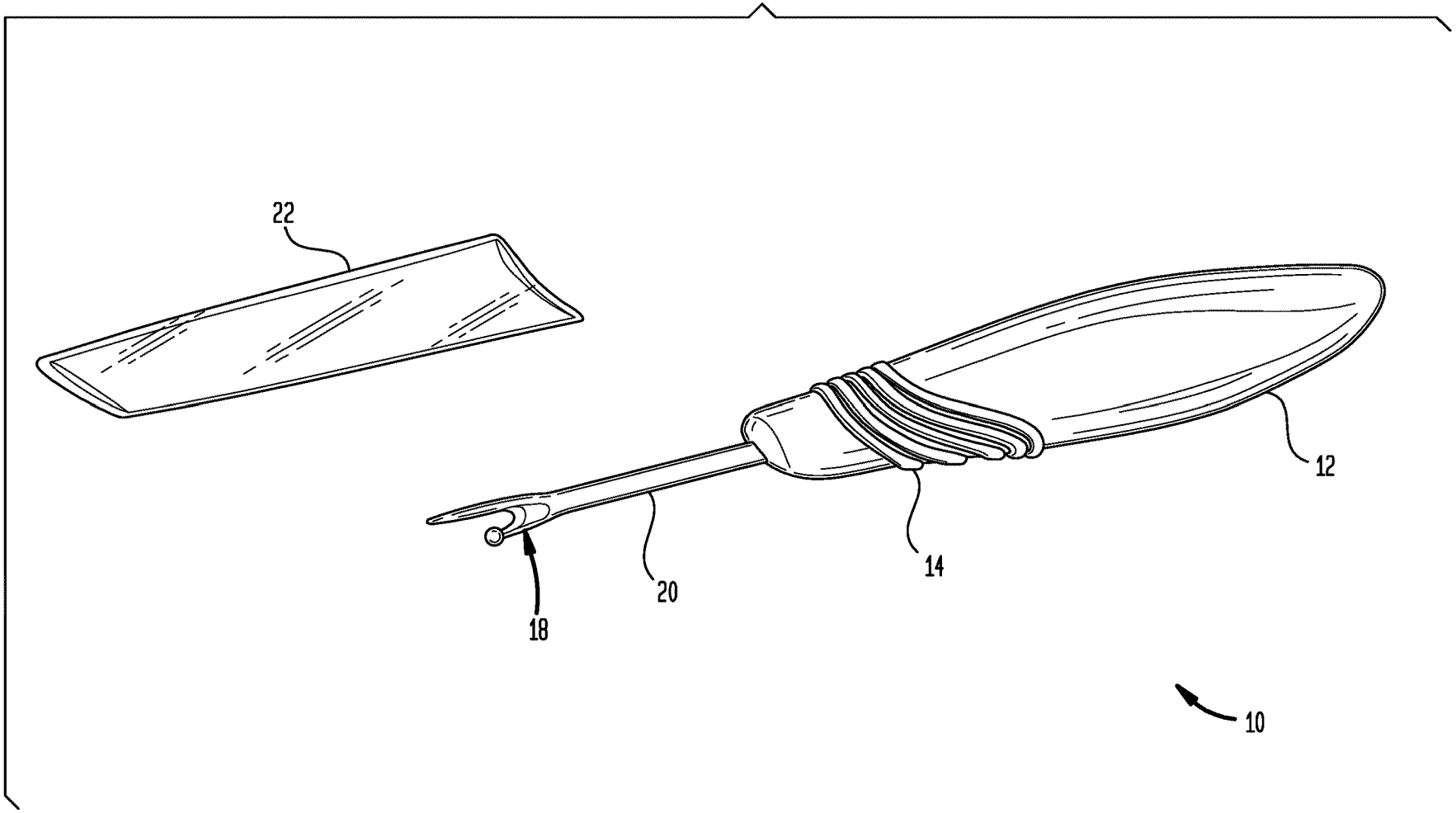
FIG. 1 is a perspective view of the inventive seam ripper.
Figure 2:
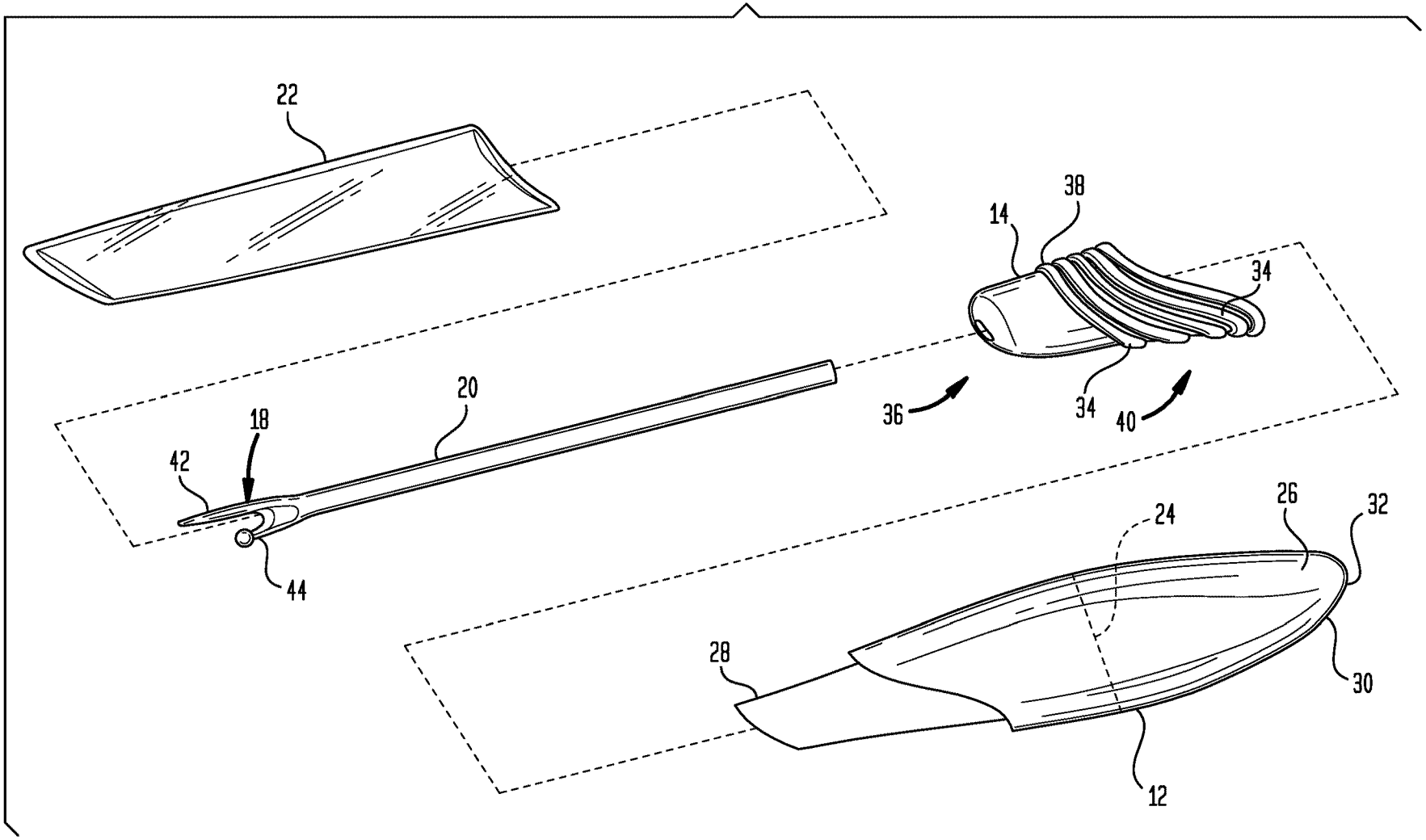
FIG. 2 is an exploded view of the seam ripper of FIG. 1.
Figure 3:
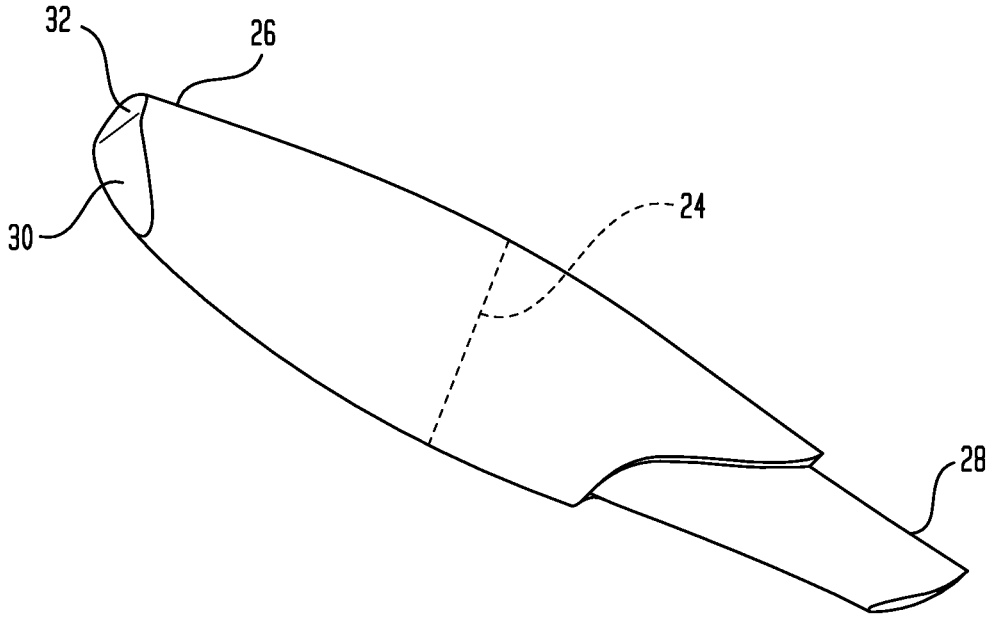
FIG. 3 is a perspective view of the haft of the inventive seam ripper of FIGS. 1 and 2.
Figure 4:
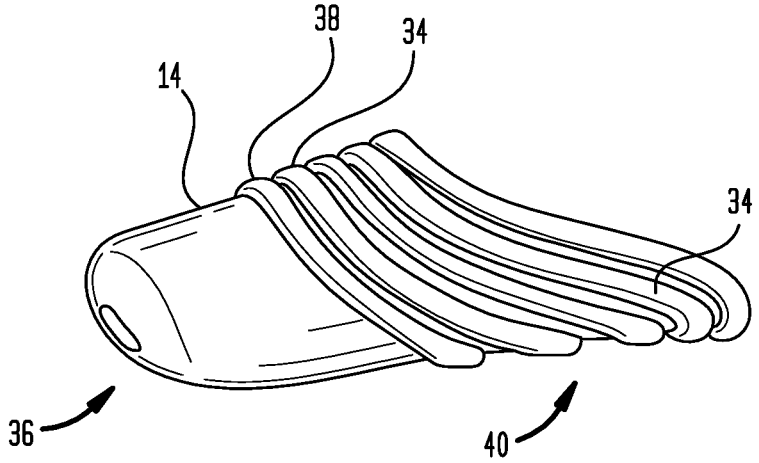
FIG. 4 is a perspective view of the gripping portion of the seam ripper of FIGS. 1 and 2.

Referring to the Figures, there is illustrated a seam ripper 10 with an ergonomic haft 12, a gripping member 14, a U-shaped cutting blade 18 with a shaft 20, as well as a protective cover 22.

Ergonomic haft 12 has a bulged profile with a larger cross-section at 24 than at a cross-section at palm end 26 or thumb grip end 28. The bulged profile fits comfortably in the hand of a user. Palm end 26 has an outer surface of generally planar structure, preferably a segmented structure as shown having generally planar panels 30, 32 which are shaped to comfortably engage the hypothenar eminence region of the palm. Panels 30, 32 are not perfectly flat, but are gently sloping as shown, referred to as a sloping planar structure. End 28 is configured to engage and secure gripping member 14.

Gripping member 14 is made of a resilient rubbery material such as a silicone rubber (polysiloxane) or the like and has a plurality of gripping ribs 34 extending around gripping member 14, as well as an end 36 sized to engage cover 22.

Ribs 34 are spaced relatively close together at an upper portion 38 and relatively further apart at lower portion 40.

Shaft 20 is secured to haft 12 such that a tapered upper projection 42 of U-shaped cutting blade 18 is aligned with upper portion 38 of gripping member 14, while a balled lower projection 44 of U-shaped cutting blade 18 is aligned with lower portion 40 of gripping member 14.

Protective cover 22 is made of a transparent or translucent material and is frictionally mounted on end 36 of gripping member 14 as shown.

In use, the more closely spaced gripping ribs 34 at 38 facilitate fabric ripping with balled end 44 inserted into the fabric, while the relatively distally spaced ribs at 40 facilitate cutting a thread seam with tapered end 42 inserted into the seam.

When developing products as he has over the past decades, the inventor of the present ergonomic seam ripper generally presents a variety of concepts to focus groups of women who engage in the relevant arts for their evaluations and comments, and thereafter seeks to refine the concepts to better suit their needs, particularly addressing difficulties arising from advanced age and the all too common arthritis afflicting seniors. When the present ergonomic seam ripper was presented to a focus group, the response to this product was unusually favorable and for the first time in the decades that the inventor has been conducting product evaluation in this way, one of the focus group members was so taken with the ergonomic seam ripper that she implored him to be able to keep the ergonomic seam ripper prototype presented for her own private use because she found it so far superior to any seam ripper that she had previously encountered in addressing the problems of arthritis that she did not want to be forced to wait for introduction of the product following conventional timelines into regular commercial channels. Of course these focus group members are so useful, that a way simply had to be found to allow her to retain the ergonomic seam ripper but temporarily returning it to the inventor when needed for developmental purposes.

What is claimed is:

1. An ergonomic seam ripper comprising:

(a) an elongated haft with a bulged profile having a larger cross-section about its medial portion than cross-section at a palm end of the haft, the cross-section about the medial portion of the haft also being larger than a cross-section at a thumb grip end of the haft, wherein the palm end of the haft has an outer surface of generally planar structure and the haft is further characterized by a mounting portion at the thumb grip end of the haft;

(b) a gripping member secured to the mounting portion of the haft and made of a resilient rubbery material with a plurality of gripping ribs extending thereabout, wherein the gripping ribs are spread relatively close together at an upper portion thereof and relatively further apart at a lower portion thereof; and (c) a U-shaped cutting blade with a tapered projection and a balled projection, as well as a shaft, wherein the shaft of the blade is secured to the haft such that the tapered projection is aligned with the upper portion of the gripping member and the balled projection is aligned with the lower portion of the gripping member.

2. The ergonomic seam ripper according to claim 1, further comprising a protective cover removably secured to the gripping member and enveloping the U-shaped cutting blade and shaft.

3. The ergonomic seam ripper according to claim 1, wherein the palm end of the haft has a sloping planar structure.

4. The ergonomic seam ripper according to claim 1, wherein the palm end of the haft has a segmented planar structure with 2 panels.

5. The ergonomic seam ripper according to claim 4, wherein the panels have a gently sloping planar structure.

6. The ergonomic seam ripper according to claim 1, wherein the palm end of the haft is configured to engage a hypothenar eminence region of a palm of a user.

7. The ergonomic seam ripper according to claim 2, wherein the cover is transparent or translucent.

8. The ergonomic seam ripper according to claim 1, wherein the gripping member is made of a polysiloxane material.

9. An ergonomic seam ripper comprising:

(a) an elongated haft with a profile defining generally convex exterior surfaces; said elongated haft having a varying cross-section along its length including a proximal cross-section defined adjacent its palm pressing-end, a distal cross-section defined adjacent its working engagement end, and a medial cross-section defined generally medially therebetween, and a gripping cross-section defined between the medial cross-section and the distal cross-section of the haft, the medial cross-section near its generally medial portion being larger than the proximal cross-section at the palm pressing end of the haft, the medial cross-section of the haft also being larger than the gripping cross-section of the haft, the palm pressing end of the haft having an outer surface of generally planar structure configured to bear against a hypothenar and generally coplanar therewith when said haft is grasped by a human hand, and the haft being further characterized by a mounting surface at the working engagement end of the haft;

(b) a gripping member secured to the mounting surface of the haft between the generally medial portion and the working engagement end of the haft, said gripping member being made of a resilient rubbery material with a plurality of gripping ribs extending thereabout, wherein the gripping ribs are spread relatively close together at an upper portion thereof and relatively further apart at a lower portion thereof, the portions of said gripping ribs near the medial portion of said haft bowing toward the working engagement end of the haft; and (c) a U-shaped cutting blade with a tapered projection and a balled projection, as well as a shaft, wherein the shaft of the blade is secured to the haft such that the tapered projection is aligned with the upper portion of the gripping member and the balled projection is aligned with the lower portion of the gripping member.

10. The ergonomic seam ripper according to claim 9, further comprising a transparent protective cover removably matingly secured to the gripping member and enveloping the U-shaped cutting blade and shaft, outer surfaces of said transparent protective cover being generally tangent to the generally convex exterior surfaces of the haft along a mating line therebetween and constituting congruous continuation of the generally convex exterior surfaces of said haft located rearwardly of said mating line.

11. The ergonomic seam ripper according to claim 9, wherein a slope of the generally planar structure at the palm end of the haft is configured and placed to align with the hypothenar when the thumb of a human hand engages said gripping member.

12. The ergonomic seam ripper according to claim 11, wherein the palm end of the haft has a segmented planar structure with 2 panels obtusely joined.

13. The ergonomic seam ripper according to claim 12, wherein the panels have a gently sloping planar structure configured to be generally congruent to the hypothenar of a human hand when a thumb is placed on the gripping member.

14. The ergonomic seam ripper according to claim 9, wherein the palm end of the haft is configured to engage a hypothenar eminence region of a palm of a user when a thumb is placed on the gripping member.

15. The ergonomic seam ripper according to claim 10, wherein the outer surfaces of the cover are generally convex.

16. The ergonomic seam ripper according to claim 9, wherein the gripping member is made of a polysiloxane material.

* * * * *